US010161068B2

(12) United States Patent
Wang

(10) Patent No.: US 10,161,068 B2
(45) Date of Patent: Dec. 25, 2018

(54) METHOD FOR PRODUCING TOWEL ULTRA-LONG LOOPED PILES

(71) Applicant: LOFTEX CHINA LTD., Binzhou, Shandong (CN)

(72) Inventor: Hongxing Wang, Binzhou (CN)

(73) Assignees: SHNGDONG WANSHENGBO SCI-TECH.CO., LTD, Dongying, Shangdong (CN); TSINGHUA UNIVERSITY, Beijing (CN)

( * ) Notice: Subject to any disclaimer, the term of this patent is extended or adjusted under 35 U.S.C. 154(b) by 312 days.

(21) Appl. No.: 15/101,902

(22) PCT Filed: Apr. 24, 2014

(86) PCT No.: PCT/CN2014/076140
§ 371 (c)(1),
(2) Date: Jun. 4, 2016

(87) PCT Pub. No.: WO2015/081655
PCT Pub. Date: Jun. 11, 2015

(65) Prior Publication Data

US 2016/0305049 A1 Oct. 20, 2016

(30) Foreign Application Priority Data

Dec. 4, 2013 (CN) ..... 2013 1 0653007

(51) Int. Cl.
*D03D 15/06* (2006.01)
*D03D 27/06* (2006.01)

(52) U.S. Cl.
CPC ..... *D03D 15/06* (2013.01); *D03D 27/06* (2013.01)

(58) Field of Classification Search
CPC ..... D03D 27/06; D03D 27/00; D03D 27/08; D03D 1/0017; D03D 39/00; D03D 27/02;
(Continued)

(56) References Cited

U.S. PATENT DOCUMENTS 4,984,606 A * 1/1991 Moore ..... D03D 27/08 139/25
5,447,182 A * 9/1995 Gehrig ..... D03D 27/08 139/25

(Continued)

FOREIGN PATENT DOCUMENTS

CN 201443004 U * 4/2010

OTHER PUBLICATIONS

English language machine translation of CN 201443004 (Doc Pub Apr. 2010), 8 pages.*

*Primary Examiner* — Amy Vanatta
(74) *Attorney, Agent, or Firm* — Raymond Y. Chan; David and Raymond Patent Firm

(57) ABSTRACT

A method for producing a towel with ultra-long looped piles is provided. First, a looped pile| is woven by using three weft yarns when weaving a towel, a fixed connecting structure for fixedly connecting looped piles is disposed outside every two looped piles| or every three looped piles, and the fixed connecting structure is formed by fixedly connecting 3 to 5 weft cotton yarns. Water soluble weft yarns are disposed between the every two looped piles| or the every three looped piles, and the water-soluble weft yarns are used as weft yarns for separating and fixedly connecting adjacent to looped piles. Then, the water-soluble weft yarns are dissolved in a dyeing and finishing process, so that the original two looped piles| or three looped piles| form one looped pile, thereby increasing the length of a looped pile, so that the towel is fluffy and soft in hand feeling, and is not easily damaged when being hooked.

16 Claims, 7 Drawing Sheets

(58) Field of Classification Search
CPC ..... D03D 15/06; D03C 3/12; D06H 7/228; D06H 7/226; D06H 7/22; D06Q 1/02
USPC ..... 28/168, 170
See application file for complete search history.

(56) References Cited

U.S. PATENT DOCUMENTS

| | | | | |
|---|---|---|---|---|
| 5,526,656 | A * | 6/1996 | Conroy, Jr. | C02F 3/103 28/168 |
| 7,762,286 | B1 * | 7/2010 | Speaks | D03D 27/08 139/21 |
| 9,534,323 | B1 * | 1/2017 | Dubey | D03D 27/08 |
| 2004/0128811 | A1 * | 7/2004 | Mandawewala | D02G 3/406 28/168 |
| 2007/0087162 | A1 * | 4/2007 | Mandawewala | D02G 3/36 428/97 |
| 2012/0247608 | A1 * | 10/2012 | Govindaswamy | D03D 15/06 139/393 |
| 2016/0208420 | A1 * | 7/2016 | Hozumi | D03D 15/0027 |

* cited by examiner

METHOD FOR PRODUCING TOWEL ULTRA-LONG LOOPED PILES

CROSS REFERENCE OF RELATED APPLICATION

This is a U.S. National Stage under 35 U.S.C. 371 of the International Application Number PCT/CN2014/076140, filed Apr. 24, 2014, which claims priority under 35 U.S.C. 119(a-d) to Chinese application number 201310653007.9, filed Dec. 4, 2013.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The invention relates to a method for producing a towel, in particular to a method for producing a towel with ultra-long looped piles, belonging to the technical field of towel production.

Description of Related Arts

With continuous development of the social economy, the requirements on commodities from consumers are increasingly high, as the article of daily use, the towel product's attractiveness and performance draw more and more attention from people. Being the main body of towel products, the visual effect of looped piles affects the appearance and grade of the product to a large extent. For general towels and products thereof, being limited by weaving performance of a loom (the principle for fuzzing of a towel loom: it is realized by overfeeding of pile warp, and generally the actual maximum overfeeding length of pile warp is 1.8 cm), the length of a single looped pile is generally lower than 1.8 cm, therefore the outlook of the product is monotonous, and it is ordinary in hand feeling.

SUMMARY OF THE PRESENT INVENTION

In order to solve the above mentioned problems, the invention provides a method for producing a towel with ultra-long looped piles, and this towel has the advantages that the single looped pile of the towel is ultra-long, the looped piles are fluffy and the towel has good visual effect.

The adopted technical scheme in the invention to solve the technical problem is that: a method for producing a towel with ultra-long looped piles. It has the special points that: first, a first looped pile is woven by using three picks-terry method when weaving a towel, a fixed connecting structure for fixedly connecting looped piles is disposed outside every two first looped piles or every three first looped piles, and the fixed connecting structure is formed by fixedly connecting 3 to 5 weft cotton yarns. Water soluble weft yarns are disposed between the every two first looped piles or the every three first looped piles, and the water-soluble weft yarns are used as weft yarns for separating and fixedly connecting adjacent first looped piles. Then, the water-soluble weft yarns are dissolved in a dyeing and finishing process, so that original two or three first looped piles form one second looped pile, thereby increasing length of a looped pile.

By adopting water-soluble weft yarns between two or three looped piles when weaving a towel, and by dissolving the said water-soluble weft yarns in the dyeing and finishing process, the original two or three looped piles form one looped pile, thereby increasing the length of the looped pile. As water-soluble weft yarns will be finally dissolved, the density of finished looped piles is lower than that of a greige towels out of looms, the fastness of the looped pile is poorer (the hook and tensile force of a looped pile is poorer), and looped piles are easily broken away from the fixed connecting structure of the towel, which can affect the usability of the towel. Therefore, the invention solves the problem of poorer fastness of the looped piles by the way of strengthening the fixed connecting structure.

In the invention, the said water-soluble weft yarns are water-soluble fiber yarns or water-soluble filament yarn.

Further, the said water-soluble weft yarns are made of PVA materials or are alkali weight reduction modified polyester fiber.

The said water-soluble weft yarns are 60s vinylon weft yarns.

During the dyeing and finishing process, weft dissolve temperature is 95° C., and it lasts for 30 minutes.

The said fixed connecting structure is of a three-weft plain weave or a three-weft satin weave or a three-weft twill weave or a five-weft plain weave or a five-weft satin weave or a five-weft twill weave.

The said fixed connecting structure is of a three-weft plain weave, the weft density of greige towels out of looms is 160 pcs/dm-380 pcs/dm; preferably, the weft density of greige towels out of looms is 200 pcs/dm.

In order to improve the fluffy and appearance performance of the product, it selects 32s/2-16s/2 or 8s-16s single yarn for yarn count of pile warp, and the twist factor is controlled to be 310-400.

The invention has the beneficial effects that the invention overcomes the defects of limitation in looped pile length and monotony in looped pile style for traditional towels, by adopting water-soluble weft yarns and the fixed connecting structure, it realizes the functions of ultra-long looped pile length, special visual effect, fluffy and soft hand feel as well as snagging resistance, with limited increasing in production cost, it breaks through greatly in style. Compare with the existing technology, the products manufactured by the invention have the following features:

1. The length of a single looped pile is long, the length for the single looped pile is between 1.8 cm-3.6 cm, and it cannot be woven by an ordinary loom;
2. It is special in style, strong in visual impact and prominent in product features.
3. The looped pile has better fluffy effect.
4. The cost for the whole production process does not increase greatly.

Still further objects and advantages will become apparent from a consideration of the ensuing description and drawings.

These and other objectives, features, and advantages of the present invention will become apparent from the following detailed description, the accompanying drawings, and the appended claims.

Figure 1:
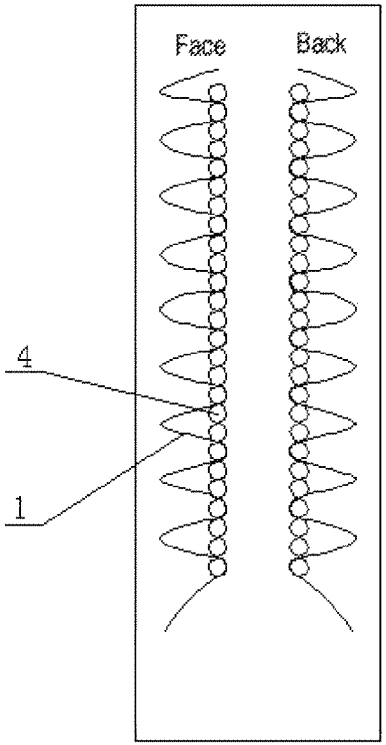
Fig. 1 PRIOR ART
FIG. 1 is a longitudinal profile schematic diagram for towels with normal looped piles.

In the figures, 1 refers to first looped pile, 2 refers to second looped pile, 3 refers to the fixed connecting structure, 4 refers to pure cotton weft yarns, and 5 refers to water-soluble weft yarns.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It gives further descriptions to the invention according to the embodiment combining with the figures hereunder:

A method for producing towels with ultra-long looped piles, the adopted technical principles are that: the weft yarns for separating and fixedly connecting between the adjacent 2 or 3 looped piles are changed from cotton yarns to water-soluble weft yarns when weaving towels via the conventional weaving method, then dissolve the water-soluble weft yarns by hot water in the dyeing and finishing process, so that the original 2 or 3 looped piles are enabled to change into one looped pile, and the looped pile is further lengthened. As the water-soluble weft yarns are finally dissolved in the dyeing and finishing process, the density of finished looped pile is lower than that of the greige towels out of looms, the looped pile is poorer in fastness (the hook and tensile force of a looped pile is poorer), the looped pile is easy to separate from the fixed connecting structure of the towel, and the usability of the towel is affected. In order to solve the problem, it is required to weave 2 or 3 looped piles to strengthen the fixed connecting structure when weaving the towels.

The water-soluble weft yarns in the invention can be water-soluble fiber yarns or water-soluble filament yarn. The water-soluble weft yarns can be made of PVA materials or can be alkali weight reduction modified polyester fiber.

The fixed connecting structure in the invention should be appropriately designed, too little fixed connecting structures may cause the result of insufficient clamping force so as to difficult to fix the looped piles, and in the case of higher looped piles, it is easy to slip. However, the fixed connecting structures cannot be too many, if so, the looped piles may not cover the fixed connecting structures, thus the towel may be sloppy, and neither the hand feeling nor style can reach the optimum requirement. Therefore, it should fully consider the weft density of greige towels out of looms of the product and the number of fixed connecting structures during design. The invention employs the technical scheme that: use 3 to 5 wefts of cotton yarns to fixedly connect a looped pile, and the fixed connecting structure can be fixedly connected through a three-weft plain weave or a three-weft satin weave or a three-weft twill weave or a five-weft plain weave or a five-weft satin weave or a five-weft twill weave. Preferably select the plain weave to realize the optimum fixed connecting effect, meanwhile it adopts 160 pcs/dm-380 pcs/dm for the semi-processed weft density, and it is preferably to use 200 pcs/dm.

Embodiment 1

Figure 2:
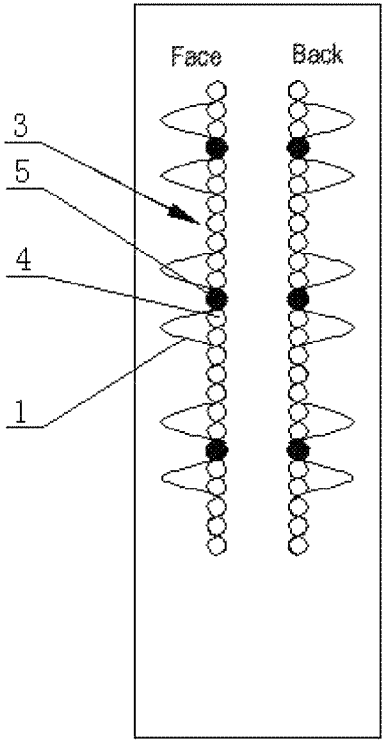
FIG. 2 is a weaving principle longitudinal profile diagram for towels with ultra-long looped piles in embodiment 1.
Figure 6:
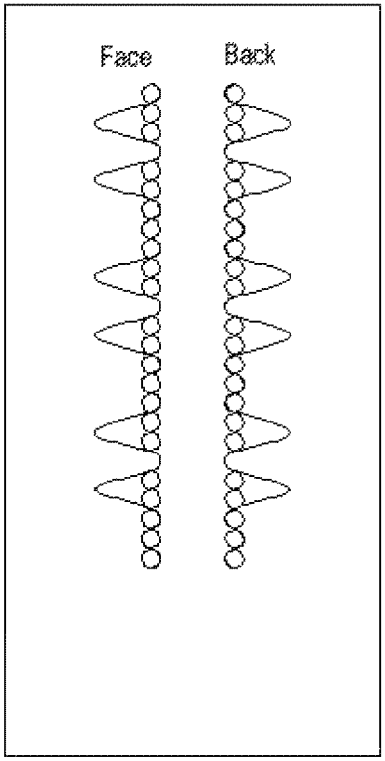
FIG. 6 is a longitudinal profile diagram after dissolving water-soluble weft yarns in FIG. 2.
Figure 10:
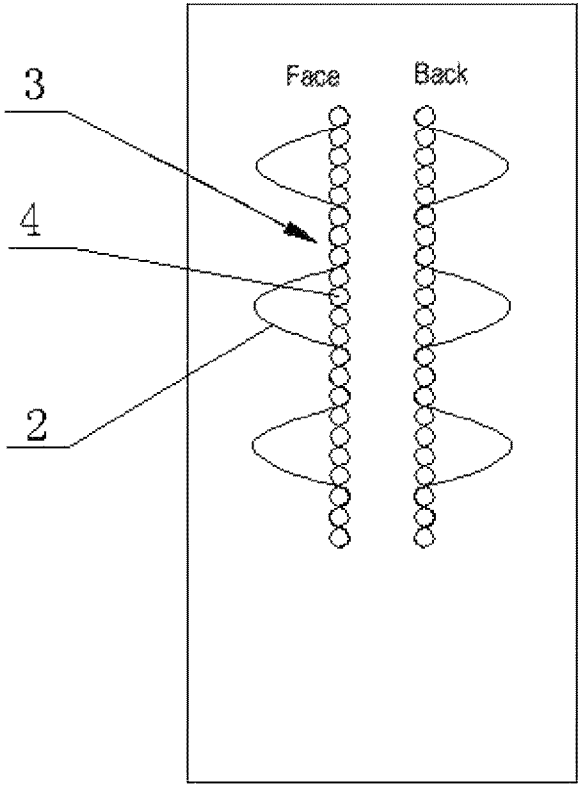
FIG. 10 is a longitudinal profile diagram for products after dyeing, finishing and drying in embodiment 1.

As shown in FIGS. 2, 6 and 10, the embodiment adopts the design that: use water-soluble weft yarns 5 for separating and fixedly connecting the weft yarns of adjacent first looped pile between every two first looped piles. After the water-soluble weft yarns are dissolved, then make the two first looped piles to form an ultra-long second looped pile; and it uses a three-weft plain weave to fixedly connect for the fixed connecting structure 3.

The invention comprises the following steps:

1) Spinning: there is no special requirement on yarns in the invention, and it can use the yarns with strength satisfying a specific weaving condition. Consider the fluffy performance and the appearance of the products, when it selects 32s/2-16s/2 or 8s-16s single yarns for pile warps yarns and yarn counts in the invention, it will have better effect, and it should control the twist factor between 310 and 400. In the embodiment, it selects 21s/2 small twisted yarns for pile warp yarns, it selects 16s single yarns and water-soluble vinylon yarns for weft yarns, and it selects 21s/2 strong twisted yarns for ground warps.

2) Warping and sizing: it selects an appropriate car speed during warping according to strength and number of heads of yarns, sizing: it adopts the starching process of "light sizing, small pressure, light permeation and heavy coating" for pile warps, appropriately smoothen hairiness, improve strength, increase abrasion resistance, and make sure to meet the weaving requirement. It adopts the starching process of "two piles high and one pile low as well as afterwaxing" for ground warps, it can improve the abrasion resistance and strength of the yarns, and it can ensure good weaving effect. In the embodiment, the warping car speed is controlled to be 550 m/min, and the sizing car speed during the sizing process is controlled to be 100 m/min. The size formula is that pile warp: 23.2 kg of corn starch, 2 kg of liquid wax; ground warp: 116 kg of modified starch, 2 kg of wax blocks and 12 kg of propylene.

3) Weaving: a first looped pile is woven by adopting three weft yarns when weaving a towel, and for weft yarns separating and fixedly connecting the adjacent first looped piles between every two first looped piles, it adopts water-soluble weft yarns 5, and the water-soluble weft yarns 5 meet the weaving condition. After every two first looped piles, the fixed connecting structure 3 is designed to realize fixed connection, and the fixed connecting structure 3 can adopt a three-weft plain weave or a three-weft satin weave or a three-weft twill weave or a five-weft plain weave or a five-weft satin weave or a five-weft twill weave. In the embodiment, it selects 60s vinylon weft yarns for water-soluble weft yarns 5, and the fixed connecting structure 3 adopts the three-weft plain weave. It employs Toyota air jet loom to weave, the rotation speed of the loom is identical to that of normal types, set the speed at 500 r/min, adjust the tensile force of pile warp yarns and ground warp yarns, which are respectively about 110 kgf and 280 kgf, and ensure successful progress of the weaving process; and adjust the parameters of rear beam height, time of the shed, heald frame height etc., and ensure successful weaving of greige towels out of looms.

4) Dyeing and finishing treatment: dissolve the water-soluble weft yarns according to dissolving temperature of the water-soluble weft yarns 5. In the embodiment, the water dissolving temperature of water-soluble weft yarns is set to be 90° C. Therefore, put cloth at the high temperature condition (95° C.), boil to 98° C., circulate for 30 min, after draining water, infiltrate into desizing agent with amount of about 0.5-1 g/l, and remove the size on the original blank after treating 20-30 min at 80° C. Then carry out bleaching and dyeing treatment, consider the physical indicators and style of the products, it is set that hydrogen peroxide (27%): 6 g/l, caustic soda (32% ionic membrane caustic soda): 6 g/l, refining agent: 1.5 g/l, hydrogen peroxide stabilizer: 1 g/l, chelating agent: 1 g/l, treat for 55 min at 98° C., and the color is defined to medium and dark color so as to better present the characteristics of the product.

It should carry out polishing treatment according to the processing requirement.

Finally, employ hydrophilic softener to carry out softening treatment.

5) Carry out dehydration, scotching and loose type drying.

6) Carry out sewing.

The other part in the embodiment adopts the existing technology, and it does not give unnecessary details herein.

Embodiment 2

Figure 3:
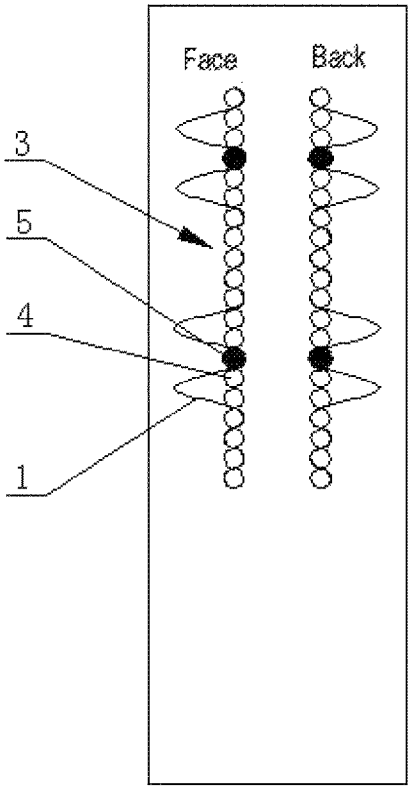
FIG. 3 is a weaving principle longitudinal profile diagram for towels with ultra-long looped piles in embodiment 2.
Figure 7:
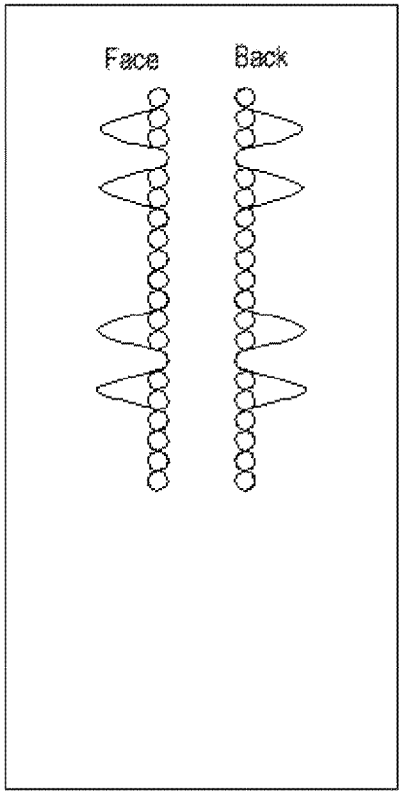
FIG. 7 is a longitudinal profile diagram after dissolving water-soluble weft yarns in FIG. 3.
Figure 11:
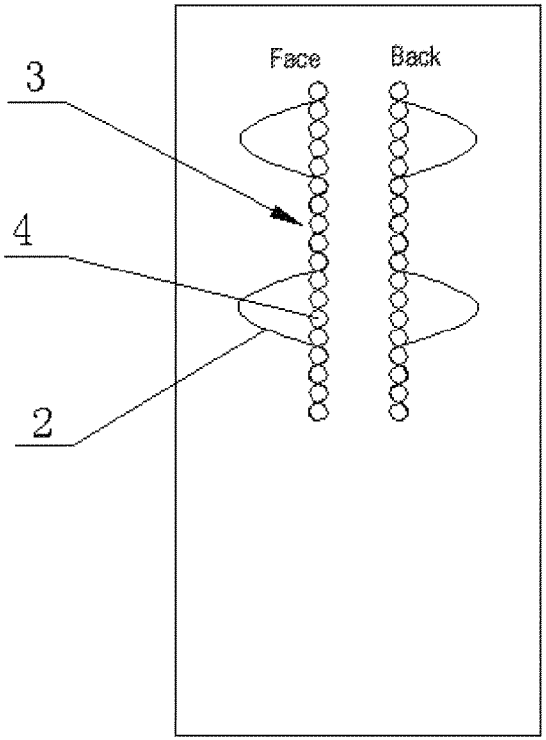
FIG. 11 is a longitudinal profile diagram for products after dyeing, finishing and drying in embodiment 2.

As shown in FIGS. 3, 7 and 11, the embodiment adopts the design that it adopts water-soluble weft yarns for separating and fixedly connecting the weft yarn of the adjacent first looped piles between every two first looped piles, and make the two first looped piles to form the ultra-long second looped pile after the water-soluble weft yarns are dissolved; and it uses the five-weft plain weave to fixedly connect.

The other parts of the embodiment are similar to that of embodiment 1, and it does not give unnecessary details herein.

Embodiment 3

Figure 4:
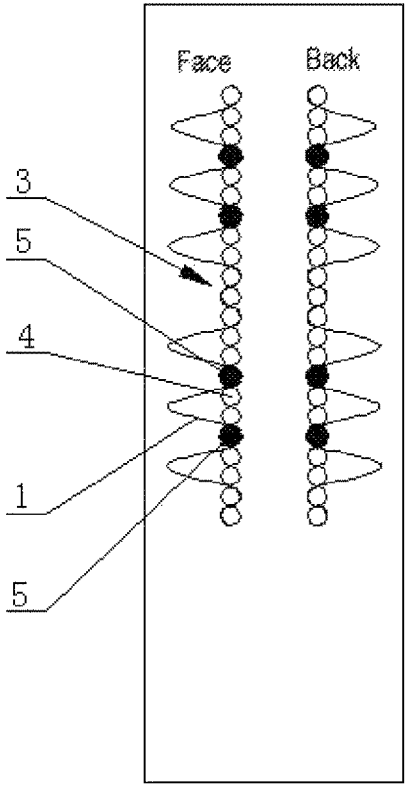
FIG. 4 is a weaving principle longitudinal profile diagram for towels with ultra-long looped piles in embodiment 3.
Figure 8:
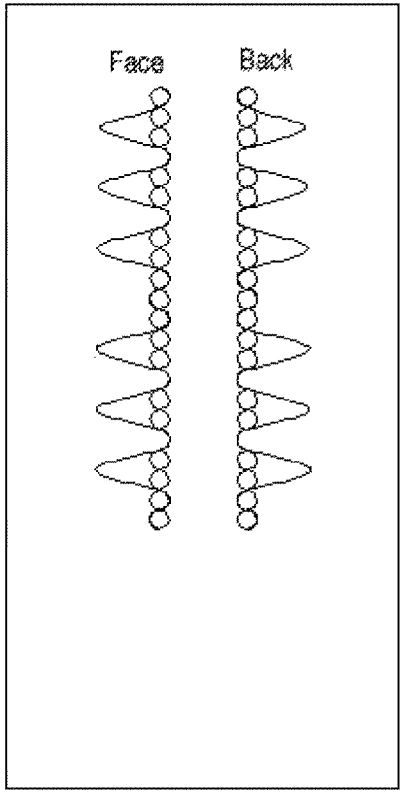
FIG. 8 is a longitudinal profile diagram after dissolving water-soluble weft yarns in FIG. 4.
Figure 12:
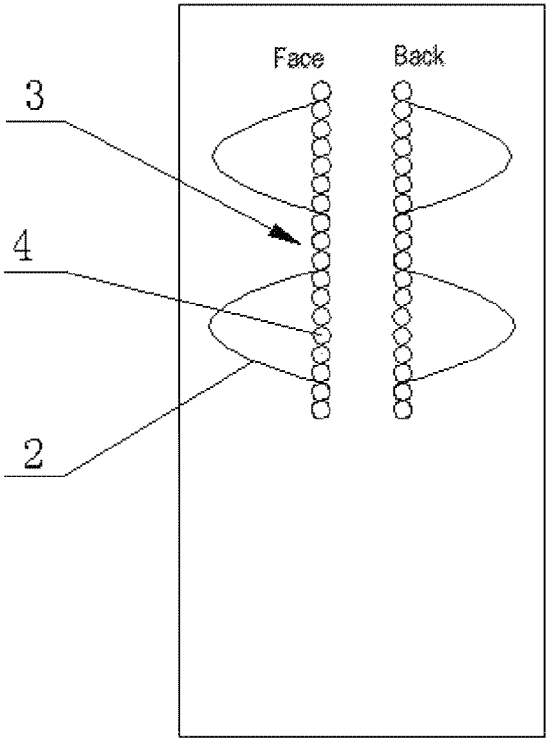
FIG. 12 is a longitudinal profile diagram for products after dyeing, finishing and drying in embodiment 3.

As shown in FIGS. 4, 8 and 12, the embodiment adopts the design that it adopts water-soluble weft yarns for separating and fixedly connecting the weft yarn of the adjacent first looped piles between every three first looped piles, and make the three first looped piles to form the ultra-long second looped pile after the water-soluble weft yarns are dissolved; and it uses the three-weft plain weave to fixedly connect.

The other parts of the embodiment are similar to that of embodiment 1, and it does not give unnecessary details herein.

Embodiment 4

Figure 5:
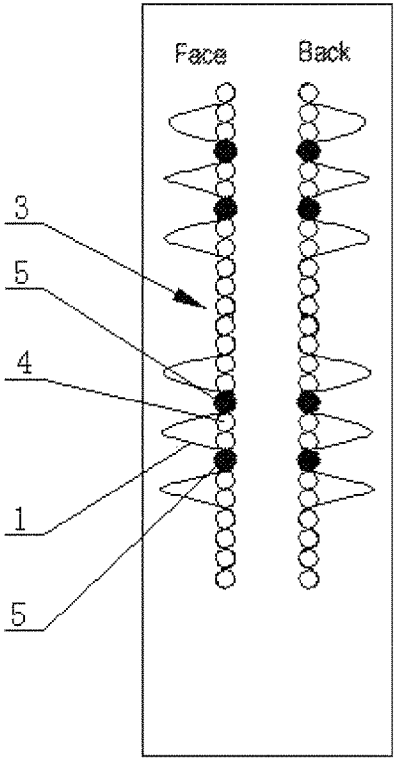
FIG. 5 is a weaving principle longitudinal profile diagram for towels with ultra-long looped piles in embodiment 4.
Figure 9:
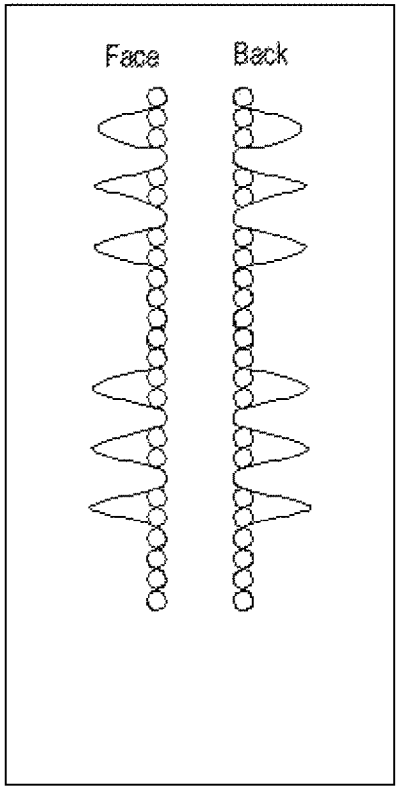
FIG. 9 is a longitudinal profile diagram after dissolving water-soluble weft yarns in FIG. 5.
Figure 13:
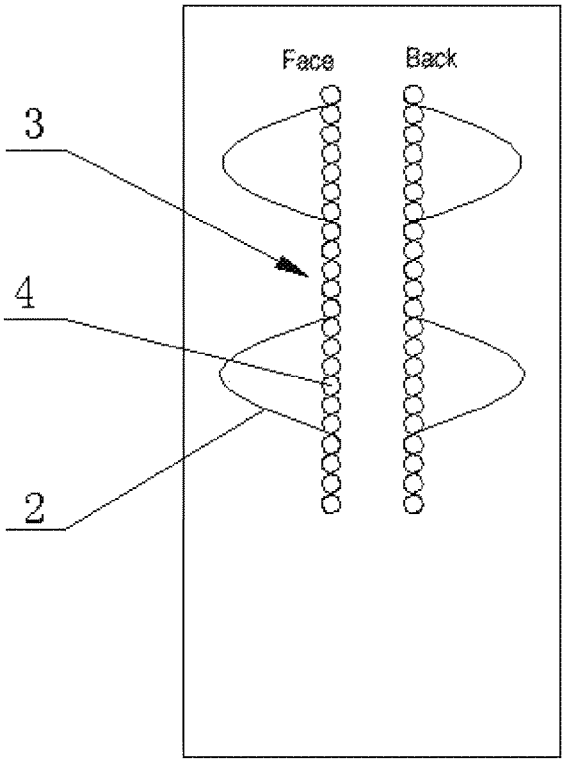
FIG. 13 is a longitudinal profile diagram for products after dyeing, finishing and drying in embodiment 4.

As shown in FIGS. 5, 9 and 13, the embodiment adopts the design that it adopts water-soluble weft yarns for separating and fixedly connecting the weft yarn 4 of the adjacent first looped piles among every three first looped piles, and make the three first looped piles to form the ultra-long second looped pile after the water-soluble weft yarns are dissolved; and it uses the five-weft plain weave to fixedly connect.

The other parts of the embodiment are similar to that of embodiment 1, and it does not give unnecessary details herein.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of producing a towel with ultra-long looped piles, comprising the steps of:

(a) weaving a first looped pile being woven by using three picks-terry method when weaving the towel, a fixed connecting structure for fixedly connecting pile loops disposed outside every two or three of the first looped pile;

(b) forming the fixed connecting structure by fixedly connecting 3 to 5 weft cotton yarns, wherein the fixed connecting structure is one of a three-weft plain weave, a three-weft satin weave, a three-weft twill weave, a five-weft plain weave, a five-weft satin weave, and a five-weft twill weave;

(c) disposing water soluble weft yarns between the every two or three of the first looped pile;

(d) using the water-soluble weft yarns as weft yarns for separating and fixedly connecting adjacent first looped piles; and (e) dissolving the water-soluble weft yarns in a dyeing and finishing process, so that an original two or three of the first looped piles form one second looped pile, thereby increasing a length of a looped pile.

2. The method, as recited in claim 1, wherein the water-soluble weft yarns are water-soluble fiber yarns or water-soluble filament.

3. The method, as recited in claim 2, wherein the water-soluble weft yarns are made of PVA materials or are alkali weight reduction modified polyester fiber.

4. The method, as recited in claim 2, wherein the water-soluble weft yarns are 60s vinylon weft yarns.

5. The method, as recited in claim 1 wherein a weft dissolve temperature in the dyeing and finishing process is 95° C. for 30 minutes.

6. The method, as recited in claim 2, wherein a weft dissolve temperature in the dyeing and finishing process is 95° C. for 30 minutes.

7. The method, as recited in claim 3, wherein a weft dissolve temperature in the dyeing and finishing process is 95° C. for 30 minutes.

8. The method, as recited in claim 4, wherein a weft dissolve temperature in the dyeing and finishing process is 95° C. for 30 minutes.

9. The method, as recited in claim 1, wherein the fixed connecting structure is of a three-weft plain weave, and the weft density of greige towels out of looms is 160 pcs/dm-380 pcs/dm.

10. The method, as recited in claim 9, wherein the weft density of greige towels out of looms is 200 pcs/dm.

11. The method, as recited in claim 1, wherein during towel weaving, 32s/2-16s/2 or 8s-16s single yarn for yarn count of pile warp is selected, and a twist factor is controlled to be 310-400.

12. The method, as recited in claim 2, wherein during towel weaving, 32s/2-16s/2 or 8s-16s single yarn for yarn count of pile warp is selected, and a twist factor is controlled to be 310-400.

13. The method, as recited in claim 3, wherein during towel weaving, 32s/2-16s/2 or 8s-16s single yarn for yarn count of pile warp is selected, and a twist factor is controlled to be 310-400.

14. The method, as recited in claim 4, wherein during towel weaving, 32s/2-16s/2 or 8s-16s single yarn for yarn count of pile warp is selected, and a twist factor is controlled to be 310-400.

15. The method, as recited in claim 9, wherein during towel weaving, 32s/2-16s/2 or 8s-16s single yarn for yarn count of pile warp is selected, and a twist factor is controlled to be 310-400.

16. The method, as recited in claim 10, wherein during towel weaving, 32s/2-16s/2 or 8s-16s single yarn for yarn count of pile warp is selected, and a twist factor is controlled to be 310-400.

* * * * *